United States Patent [19]

Trenary

[11] 4,442,831

[45] Apr. 17, 1984

[54] ON/OFF HANDLE FOR ORAL HYGIENE APPARATUS

[75] Inventor: John M. Trenary, Fort Collins, Colo.

[73] Assignee: Teledyne Industries, Inc.

[21] Appl. No.: 428,904

[22] Filed: Sep. 30, 1982

[51] Int. Cl.[3] ..... A61H 9/00

[52] U.S. Cl. ..... 128/66; 222/321

[58] Field of Search ..... 128/66, 62 A, 200.21; 604/131, 149, 150, 151, 181, 183, 257; 222/320, 321, 373, 380, 383, 401, 402.24, 402.15, 402.14, 402.1, 133, 206; 433/80, 88, 100

[56] References Cited

U.S. PATENT DOCUMENTS

| | | | |
|---|---|---|---|
| 3,227,158 | 1/1966 | Mattingly | 128/66 |
| 3,465,751 | 9/1969 | Powers | 128/66 |
| 3,476,105 | 11/1969 | Abramowitz | 128/66 |
| 3,540,437 | 11/1970 | Troy | 128/66 |
| 3,570,525 | 3/1971 | Borsum et al. | 128/66 |
| 3,590,813 | 7/1971 | Roszyk | 128/66 |
| 3,851,643 | 12/1974 | Musy | 128/66 |
| 4,078,705 | 3/1978 | Butcher | 222/402.24 |
| 4,302,186 | 11/1981 | Cammack et al. | 433/80 |

FOREIGN PATENT DOCUMENTS

| | | | |
|---|---|---|---|
| 2,852,576 | 6/1979 | Fed. Rep. of Germany | 433/100 |
| 1362320 | 4/1964 | France | 433/100 |

*Primary Examiner*—John J. Wilson

*Attorney, Agent, or Firm*—Hugh H. Drake

[57] ABSTRACT

An oral hygiene apparatus includes means for producing a succession of water pulses at a preselected pressure together with means for delivering those water pulses into a handle shaped to be grasped by the human hand. An elongated nozzle projects outwardly from the handle, manipulation of the handle permitting the water pulses, flowing through the nozzle from the handle, to be directed against the teeth and gums of the user. Included within the handle are means to define a flow path from the delivery means into the nozzle. A valve disposed within the handle is selectively operable to open or close that flow path during the delivery of the water pulses. Also disclosed is the inclusion of an accumulator within the handle for adsorbing the pressure load of incoming water pulses during closure of the valve.

6 Claims, 5 Drawing Figures

ON/OFF HANDLE FOR ORAL HYGIENE APPARATUS

The present invention relates to oral hygiene apparatus. More particularly, it pertains to apparatus which permits control of the flow of the water pulses at a hand-held handle from which a nozzle projects.

The oral hygiene art includes a number of approaches for applying a pulsating flow of water to the teeth and gums of the user. Representative of that prior art are U.S. Pat. No. 3,227,158—Mattingly and U.S. Pat. No. 4,302,186—Cammack. In such apparatus, a pump receives water and produces pulses which are outletted through a small nozzle against the surfaces of the teeth and gums.

In using apparatus such as that described in the aforesaid patents, operation typically involves a requirement upon the user to selectively operate an on/off control, such as a switch located on the pumping unit or a valve otherwise associated more directly therewith. To avoid emitting the water pulses to an undesired location, such as a wall or countertop, it has been necessary for the user first to place the nozzle into the mouth before turning on the delivery of the water pulses and to make sure that the unit is turned off before removing the nozzle from the mouth. At best, that requires the use of two hands in order to complete the entire operation, and lack of attention by the user can and has led to the necessity of a clean-up operation on adjacent areas. In addition, it may be an inconvenience for the user to have to reach over and turn off the unit before inspecting the interior of the mouth.

It is, accordingly, a general object of the present invention to provide a new and improved oral hygiene apparatus that assists in overcoming deficiencies which have been found to exist in prior such apparatus.

Another object of the present invention is to provide apparatus which enables a user to have single-handed control of both the flow of the water pulses and the manipulation of the delivery of those water pulses.

A further object of the present invention is to accomplish the foregoing aims and objectives in a simple to manufacture and economical manner.

An oral hygiene apparatus constructed in accordance with the present invention includes means for producing a succession of water pulses at a preselected pressure together with means for delivering those water pulses to a handle shaped to be grasped by the human hand. An elongated nozzle projects outwardly from the handle with manipulation of the handle permitting the water pulses flowing through the nozzle from the handle to be directed against the teeth and gums of the user. Included within the handle are means to define a flow path from the delivery means into the nozzle. A valve is disposed within the handle for selectively opening or closing the flow path. Also enclosed are means disposed in association with the handle for controlling operation of the valve during delivery of the water pulses. A related and additional feature is the incorporation, also within the handle, of a pressure accumulator which is operative during a shut-off of the ultimate delivery of the water pulses into the user's mouth.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements and in which:

Figure 1:
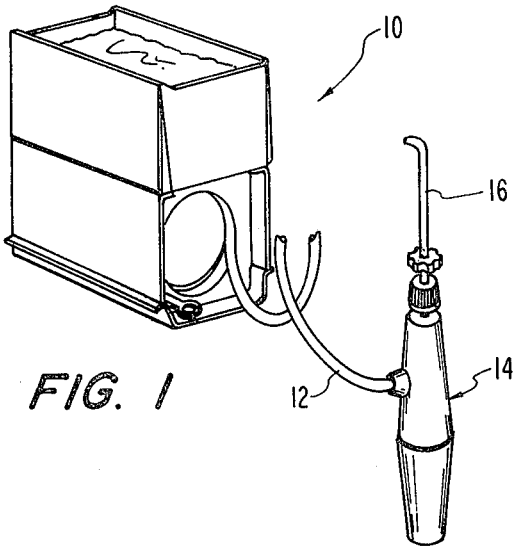
FIG. 1 is an isometric view of an entire oral hygiene apparatus which includes an improved handle constructed in accordance with the further disclosure which follows.
Figure 2:
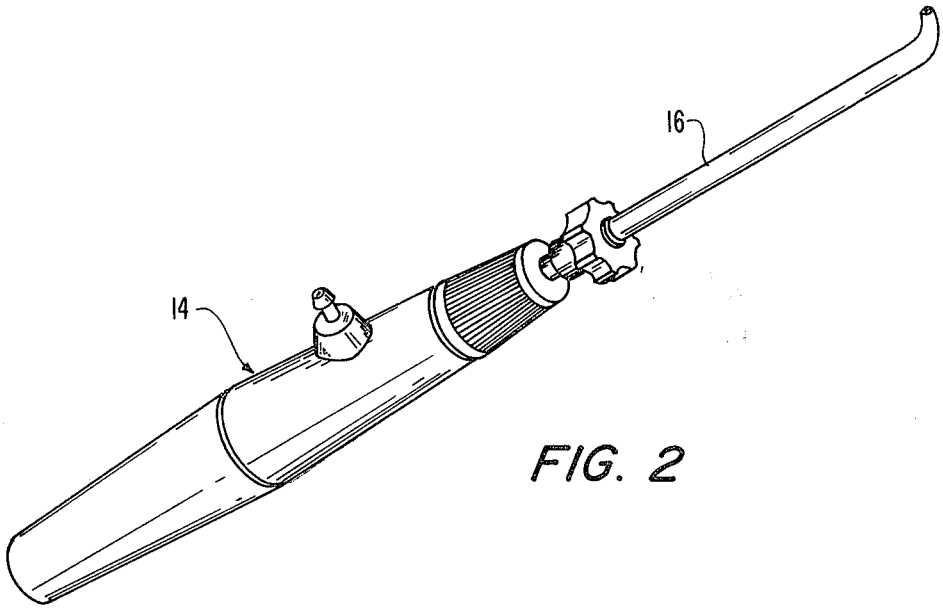
FIG. 2 is an isometric view of that improved handle with the components arranged to allow delivery of water pulses into the mouth.

An oral hygiene appliance 10 supplies successive water pulses at a preselected or predetermined pressure. Suitable versions of such an appliance are fully disclosed in U.S. Pat. No. 3,227,158—Mattingly and U.S. Pat. No. 4,302,186—Cammack. Accordingly, those patents are incorporated herein by reference for use of either of them as a source of a succession of water pulses.

Hose 12 leads from applicance 10 to a handle 14 which is shaped and permitted to be grasped by the human hand. Projecting outwardly from handle 14 is an elongated nozzle 16. Manipulation of handle 14 permits the water pulses, flowing through the nozzle from the handle, to be directed against the teeth and gums of the user.

Handle 14 is composed of a rear housing 20 threadably coupled to a front housing 22 from which laterally projects a nipple 24 to which hose 12 is connected. Within rear housing 20 is defined an interior cavity 26 within which projects a resilient bladder 28 so formed that its upper rim 30 is captivated between the two housing portions by means of a spacer 32.

Figure 3:
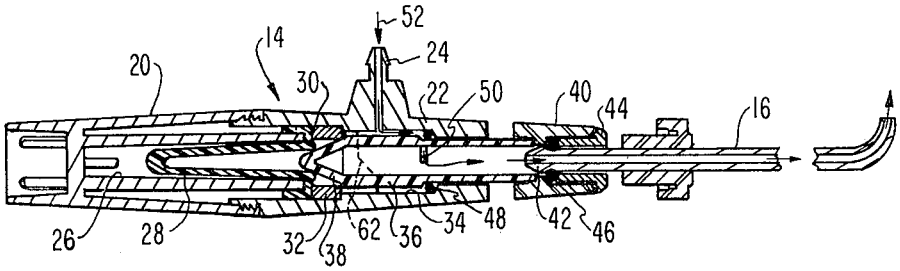
FIG. 3 is a longitudinal cross-sectional view illustrating the handle of FIG. 2 in a condition for permitting the ultimate delivery of the water pulses.

Front housing 22 also is hollowed to define an interior cavity 34 within which is disposed a longitudinally-movable hollow valve 36. A nose 38 on valve 36 seats within the rim area 30 of bladder 28 in order to close the entrance to the bladder when the valve is moved to the left as shown in FIG. 3.

At its other end, valve 36 is bonded to an end cap 40 and opens therethrough into the inward end 42 of nozzle 16. The latter is seated within end cap 40 by means of a retainer 44 that captivates an O-ring 46 which sealingly engages with an annular groove formed in the exterior sidewall of nozzle 16 at that point.

Seated into the interior wall of cavity 34 is another O-ring 48 located somewhat intermediate the length of valve 34. Included in the sidewall of valve 36 is an opening 50 which leads into the interior of the valve member. As shown in FIG. 3, opening 50 is disposed just to the rear of O-ring 22, so as to permit delivered water pulses, indicated by an arrow 52, to be delivered through nipple 24 and flow along the exterior wall surface of valve 36, flow through opening 50 and thereafter flow through nozzle 16. During that mode of operation, nose 38 is seated against the opening in lip 30 of bladder 28.

Figure 4:
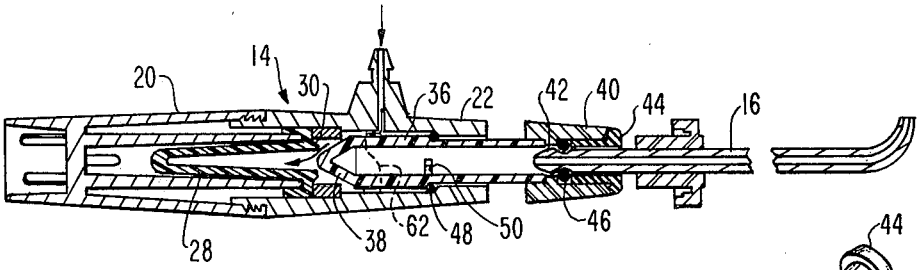
FIG. 4 is a similar view illustrating the handle with the components illustrated for an off-flow condition of the handle.
Figure 5:
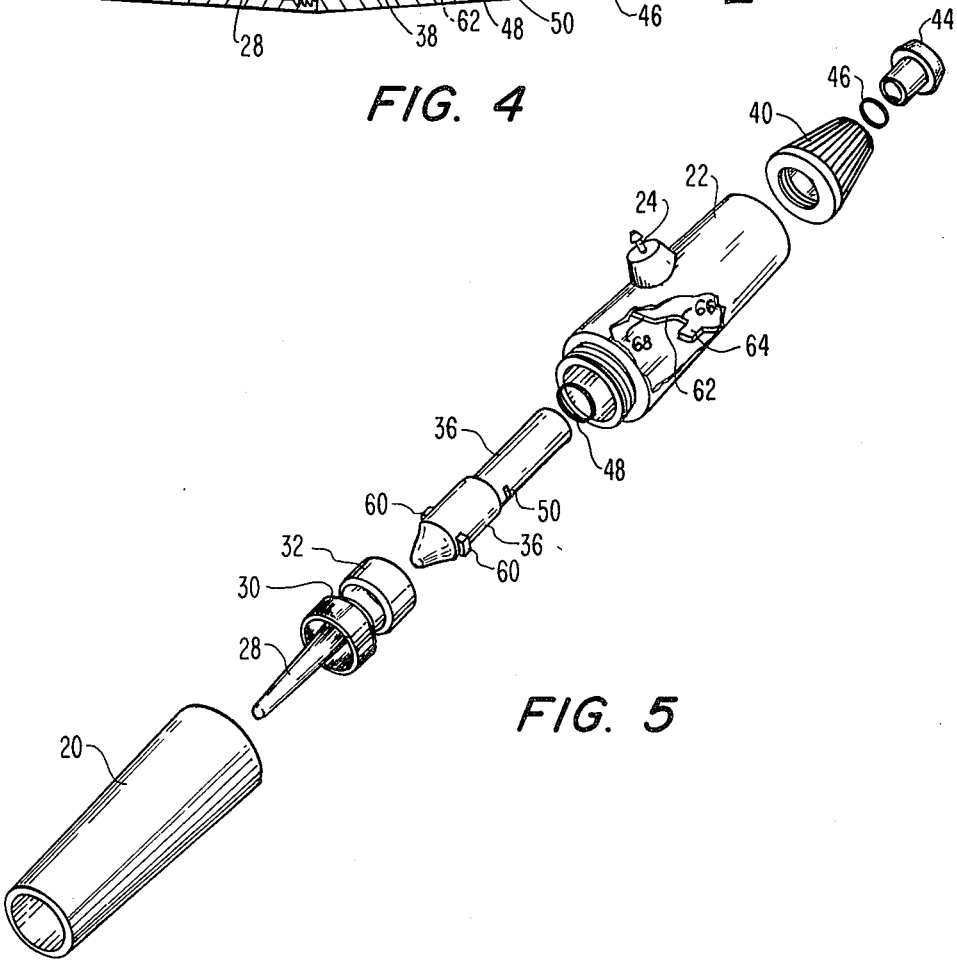
FIG. 5 is an exploded isometric view, partially broken away, further illustrating the general arrangement of the individual parts of the assemblage.

In a different mode of operation, however, valve 36, as shown in FIG. 4, has been moved in a forward direction. Under that condition, outlet 50 is closed by O-ring 48. At the same time, however, nose 38 has been pulled to the right in FIG. 4, so that the incoming flow of water pulses is permitted to travel into the interior of bladder 28. Thereupon, bladder 28 accumulates and collectively adsorbs a substantial portion of the pressure in each pulse of water. In the environment concerned, that pressure may be, for example, of the order of 160 pounds per square inch. The incorporation of bladder 28 enables the pressure to drop to, perhaps, 65 pounds per square inch. This removes the "dead-head" back pressure imposed upon the pump in unit 10. In turn, that reduction of back pressure serves well to increase the life of the pumping apparatus.

In overall principle, it might be sufficient if nozzle 16 and end cap 40 were simply movable longitudinal so as to move valve 36 between its open and closed conditions with respect to either of the ultimate flow paths. However, the action of valve 36 must be urged, in this case by manual manipulation, against the significant force or bias of the pressure developed by the incoming water pulses. To overcome that force biasing, the assembly preferably includes cam followers 60 projecting laterally from the lateral exterior of valve 36. Cam followers 60 ride against a cam track 62 formed within housing portion 22. As a result, a twisting of end cap 40 causes valve 36 to be cammed into its open-flow condition in which nose 38 closes communication to bladder 28. Upon the twisting of cap 40 in the opposite direction, valve 36 is driven into the other condition in which the water flow is through opening 50 as shown in FIG. 3. The maximum movement of valve 36 for the off condition is limited by a stop 64.

Cam track 62 includes individual flats 66 and 68 at its respective opposite ends. Each flat acts as a lock or seat for cam followers 60. Accordingly, it is not necessary to hold knob 40 in order for the valve to stay fixed in either the on or off condition.

By reason of the particular ordering of the components, a user, holding handle 14 in one hand, can use his thumb and forefinger to manipulate cap 40 for the purpose of controlling the flow of water through nozzle 16. That enables the user to allow unit 10 to continue its operation while having ultimate and very convenient control of actual outlet before and after nozzle 16 may actually be inserted in the mouth.

It may be noted that the camming or other action, incorporated to overcome the force of the incoming water pulses, may alternatively be substituted into the interior of end cap 40 rather than as a part of valve 36. Still further, some other type of coupling, such as a bayonet connection in either part might be employed. However, the illustrated arrangement has been found to be most satisfactory. Of course, nozzle 16 might be permanently affixed into cap 40. That is not believed to be as preferable, in that different persons using the same apparatus may prefer to employ their own personal nozzles, or it may be desired to have a plurality of nozzles with different size orifices in order to have a degree of control upon the characteristics of the emitted jet. In a still different alternative, bladder 28 might be located elsewhere in the total system. Nevertheless, its inclusion within the body of the handle 14 advantageously takes advantage of space already available and avoids any need to modify any other part of the overall system.

While a particular embodiment of the invention has been shown and described, and alternatives have been mentioned, it will be obvious to those skilled in the art that changes and modifications may be made without departing from the invention in its broader aspects. Therefore, the aim in the appended claims is to cover all such changes and modifications as fall within the true spirit and scope of that which is patentable.

I claim:

1. Oral hygiene apparatus comprising:

means for producing a succession of water pulses at a preselected pressure;

a handle shaped to be grasped by the human hand;

means for delivering said water pulses from said producing means into said handle;

an elongated nozzle projecting outwardly from said handle, manipulation of said handle permitting said water pulses, flowing through said nozzle from said handle, to be directed against the teeth and gums of the user;

means included within said handle to define a flow path from said delivering means into said nozzle;

storage means disposed to communicate with said flow path and accumulate pressure in said water pulses;

a valve member disposed in said flow path within said handle and movable between a first position, in which said flow path to said nozzle is opened and communication of said flow path with said storage means is closed, and a second position in which said flow path to said nozzle is closed and communication of said flow path with said storage means is open;

means included in said valve member and said handle for biasing said valve member by the pressure in said water pulses to remain in whichever one of said positions it resides;

and actuating means disposed in association with said handle for overcoming the bias by said pressure and moving said valve member from either one of said positions to the other.

2. Apparatus as defined in claim 1 in which said storage means includes a resilient bladder located within said handle external to and separate from but adjacent to said valve member, actuation of said valve member opening and closing the entrance to said bladder.

3. Apparatus as defined in claim 1 in which said actuating means includes means for camming said valve member between said positions with a force sufficient to overcome the pressure in said water pulses which resists movement of said valve member away from one of said positions toward the other.

4. Apparatus as defined in claim 1 in which said valve member is hollow and said flow path to said nozzle extends through the interior of said valve member.

5. Apparatus as defined in claim 1 in which valve member moves longitudinally within said handle between said first and second positions.

6. Apparatus as defined in claim 5 in which said actuating means functions in response to the linear actuation thereof and which further includes means for converting said linear actuation through rotary actuation that moves said valve member longitudinally.

* * * * *